US008186282B1

(12) United States Patent
Sinchok et al.

(10) Patent No.: US 8,186,282 B1
(45) Date of Patent: May 29, 2012

(54) ADJUSTABLE HEIGHT TABLE

(75) Inventors: John D. Sinchok, Hudson, OH (US); Thomas Joseph Manion, Tallmadge, OH (US); Daniel R. Simpson, Cuyahoga Falls, OH (US); Michael T. Carnahan, Willoughby, OH (US)

(73) Assignee: The Step2 Company, LLC, Streetsboro, OH (US)

( * ) Notice: Subject to any disclaimer, the term of this patent is extended or adjusted under 35 U.S.C. 154(b) by 239 days.

(21) Appl. No.: 12/752,302

(22) Filed: Apr. 1, 2010

Related U.S. Application Data

(60) Provisional application No. 61/166,154, filed on Apr. 2, 2009.

(51) Int. Cl.
*A47B 9/00* (2006.01)

(52) U.S. Cl. ... 108/147.12; 108/25; 108/12; 108/147.13

(58) Field of Classification Search ..... 108/25, 108/24, 147.12, 147.14, 147.18, 147.17, 108/147.21, 147.13, 156, 14, 193, 192, 180, 108/19; 446/70; 434/151
See application file for complete search history.

(56) References Cited

U.S. PATENT DOCUMENTS 3,566,816 A * 3/1971 Zilg et al. ..... 108/14
3,604,369 A * 9/1971 Maslow ..... 108/147.13
3,687,092 A * 8/1972 Manning ..... 108/156
4,056,892 A * 11/1977 Atencio ..... 434/151
5,244,271 A * 9/1993 Hackwood et al. ..... 108/156
5,556,181 A * 9/1996 Bertrand ..... 108/25
5,676,263 A * 10/1997 Chang ..... 108/147.13
5,971,764 A * 10/1999 Todd ..... 434/151
6,318,572 B1 * 11/2001 Lai ..... 108/147.13
6,607,418 B2 * 8/2003 Henry ..... 446/70
6,662,732 B2 * 12/2003 Birsel et al. ..... 108/25
6,976,434 B2 * 12/2005 Roig et al. ..... 108/25
7,510,479 B2 * 3/2009 Stengel ..... 108/25
7,574,966 B1 * 8/2009 Stephens et al. ..... 108/157.1
2005/0000394 A1 * 1/2005 Cheng ..... 108/25

OTHER PUBLICATIONS

Naturally Playful® Sand Table; The Step2 Company, LLC; Apr. 19, 2005; Product Detail: http://images.step2.com/media/pdfs/759403_info.pdf, 1 page; Assembly Instructions: http://images.step2.com/media/pdfs/759403_assembly.pdf, 2 pages; total of 3 pages.
Sand & Water Cart™; The Step2 Company, LLC; Oct. 15, 2007; Product Detail: http://images.step2.com/media/pdfs/780600_info.pdf, 1 page; Assembly Instructions: http://images.step2.com/media/pdfs/780600_assembly.pdf, 5 pages; total of 6 pages.
Naturally Playful® Sand & Water Activity Center; The Step2 Company, LLC; in the public domain prior to Apr. 2, 2008, believed to be circa 2000; Product Detail: http://images.step2.com/media/pdfs/743702_info.pdf, 1 page; Assembly Instructions: http://images.step2.com/media/pdfs/743702_assembly.pdf, 3 pages; total of 4 pages.

(Continued)

*Primary Examiner* — Jose V Chen
(74) *Attorney, Agent, or Firm* — Ulmer & Berne LLP

(57) ABSTRACT

A table includes a base and a plurality of legs supporting the base. The base is vertically adjustable relative to each of the legs and relative to a support surface, upon which the legs are configured to rest.

13 Claims, 9 Drawing Sheets

OTHER PUBLICATIONS

Waterwheel Play Table™, The Step2 Company, LLC; Oct. 19, 2005; Product Detail: http://images.step2.com/media/pdfs/753800_info.pdf, 1 page; Assembly Instructions: http://images.step2.com/media/pdfs/753800_assembly.pdf, 3 pages; total of 4 pages.

Sand & Water Transportation Station™; The Step2 Company, LLC; in the public domain prior to Apr. 2, 2008; Product Detail: http://images.step2.com/media/pdfs/790300_info.pdf, 1 page; Assembly Instructions: http://images.step2.com/media/pdfs/790300_assembly.pdf, 5 pages; total of 6 pages.

Water Rush Quarry™; The Step2 Company, LLC; In the public domain prior to Apr. 2, 2008; Product Detail: http://images.step2.com/media/pdfs/798800_info.pdf, 1 page; Assembly Instructions: http:images.step2.com/media/pdfs/798800_assembly.pdf, 4 pages; total of 5 pages.

* cited by examiner

ADJUSTABLE HEIGHT TABLE

CROSS-REFERENCE TO RELATED APPLICATION

This application claims the priority benefit of U.S. Provisional Patent Application Ser. No. 61/166,154, "Adjustable Height Table", filed Apr. 2, 2009, which is hereby expressly incorporated by reference herein in its entirety.

TECHNICAL FIELD

This application is related to tables, and more particularly, to adjustable height tables.

BACKGROUND

Play tables for children are known that include multiple receptacles for containing water, sand or other material, as well as toys or other play items, with the tables having a fixed height above a support surface. Due to the fixed height, the tables do not readily accommodate use by children of differing heights.

SUMMARY

According to one embodiment, a table includes a base and a plurality of legs supporting the base. The base includes an upper surface and a plurality of wells. Each of the wells has an open top and is configured to contain at least one of sand and water. The base is vertically adjustable relative to each of the legs and relative to a support surface, upon which the legs are configured to rest.

According to another embodiment, a table includes a base, a plurality of legs supporting the base, and a plurality of bands. The base includes an upper surface and a plurality of pockets. Each of the legs includes a first band-engaging region and a second band-engaging region spaced from the first band-engaging region. Each of the pockets of the base includes a bottom surface and defines an aperture that extends through the bottom surface. Each of the legs is received by the aperture defined by a respective one of the pockets of the base. The table is selectively configurable in a first configuration wherein the upper surface of the base is positioned a first distance above a support surface, upon which the legs are configured to rest. The table is further selectively configurable in a second configuration wherein the upper surface of the base is positioned a second distance above a support surface, upon which the legs are configured to rest, the first distance being greater than the second distance. Each of the bands is releasably attached to, and at least partially surrounds, the first band-engaging region of a respective one of the legs, and is in contacting engagement with the base, when the table is in the first configuration. Each of the bands is releasably attached to, and at least partially surrounds, the second band-engaging region of the respective one of the legs, and is in contacting engagement with the base, when the table is in the second configuration.

BRIEF DESCRIPTION OF THE DRAWINGS

It is believed that certain embodiments will be better understood from the following description taken in conjunction with the accompanying drawings wherein.

DETAILED DESCRIPTION

Figure 1:
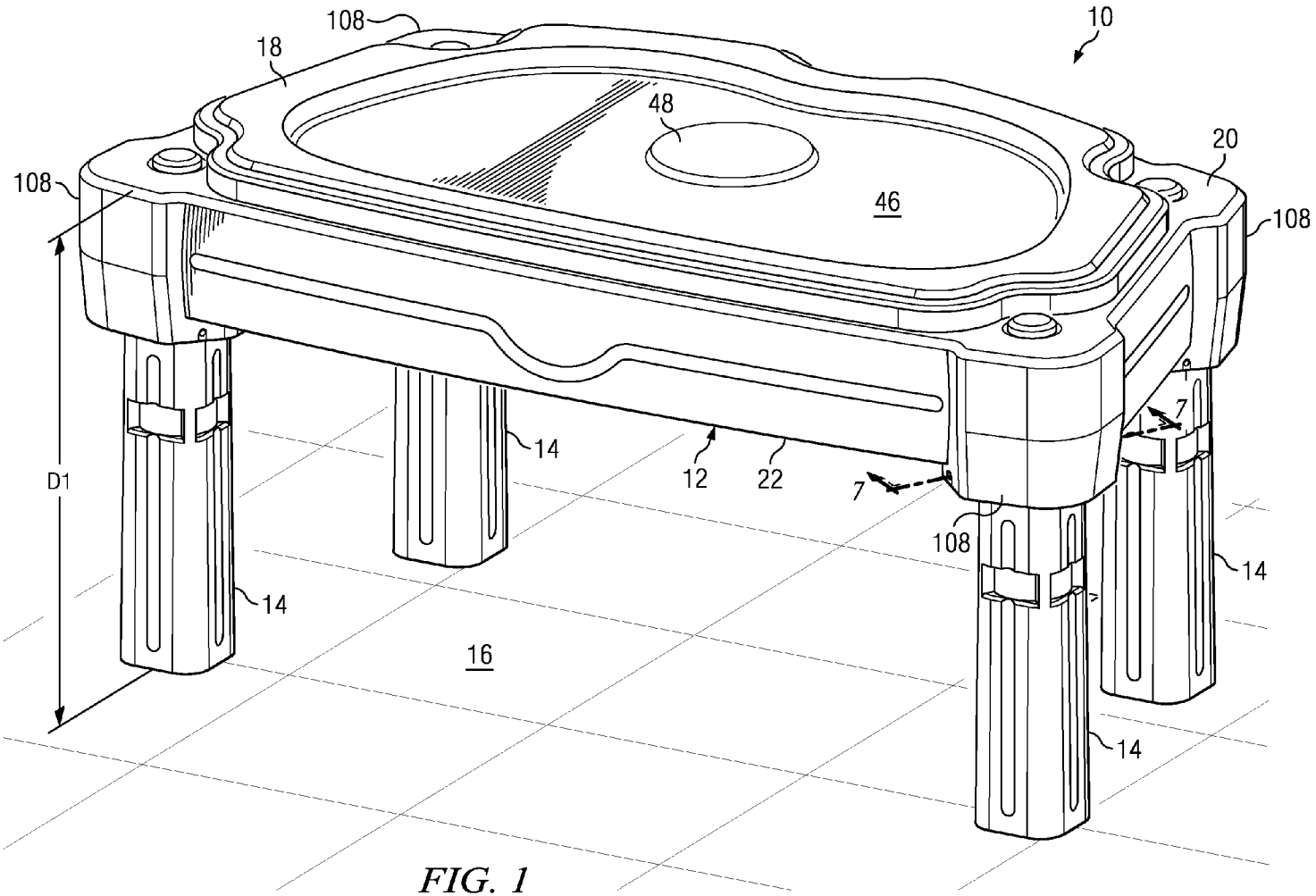
FIG. 1 is a perspective view depicting an adjustable height table according to one embodiment, wherein each of the legs of the table is in a respective first position with respect to a base of the table such that the table is in a first configuration.

Referring to the drawings, wherein like reference numbers indicate the same or corresponding elements throughout the views, FIG. 1 depicts an adjustable height table 10, according to one embodiment. Table 10 can include a base 12 and a plurality of legs 14 supporting the base 12. Each of the legs 14 can be identical, or at least substantially identical, to one another. When table 10 is in use, the legs 14 can rest on, and be supported by, a support surface 16, which can be an indoor or an outdoor floor or ground surface. The table 10 can further include a lid 18 that can be selectively positioned atop, and in contacting engagement with, the base 12 of table 10, as shown in FIG. 1.

Figure 2:
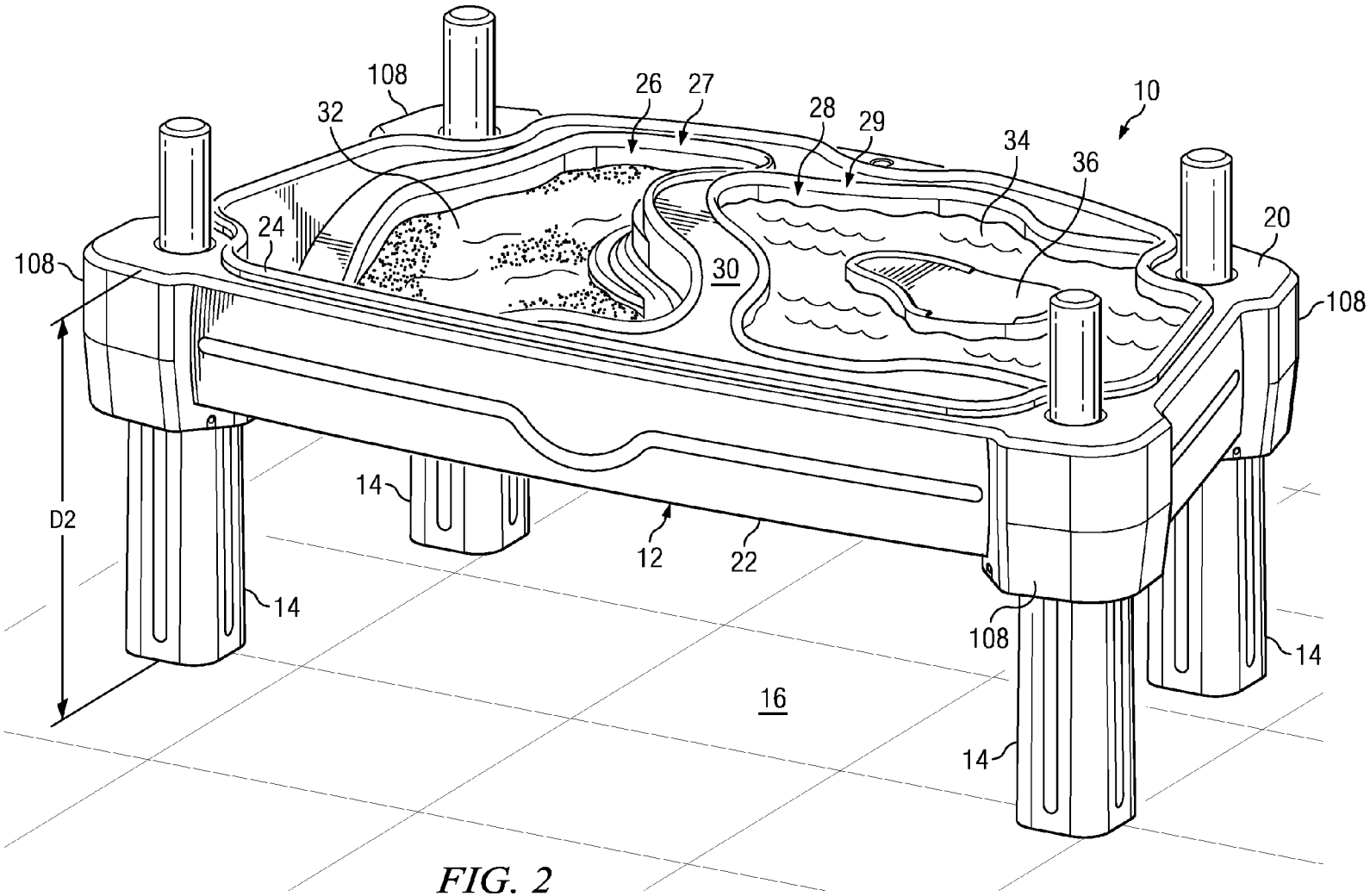
FIG. 2 is a perspective view similar to FIG. 1, but with each of the legs of the table being depicted in a respective second position with respect to the base of the table such that the table is in a second configuration, with a lid of the table removed, with a first well of the base of the table containing sand, and with a second well of the base of the table containing water.

Base 12 can include an upper surface 20, a lower surface 22, and a perimeter lip 24 (FIG. 2) that can extend upwardly from the upper surface 20. When the lid 18 is selectively positioned atop the base 12, the lid 18 can be in contacting engagement with the upper surface 20 of base 12 and can surround, or at least substantially surround, the perimeter lip 24 such that the perimeter lip 24 positions the lid 18 relative to the base 12. In one embodiment, a lid can be provided that is releasably attached to a base of a table. The base 12 can further include at least one well, that can be configured to contain sand, water, and/or other material such as earth or soil, and/or various children's toys or other play items. Table 10 is shown in FIG. 2 to include a first well 26 and a second well 28. The first well 26 can have an open top 27 and the second well 28 can have an open top 29. In one embodiment, the base 12 can include a partition 30, which can separate the first well 26 and the second well 28, as shown in FIG. 2. The first well 26 is shown in FIG. 2 to contain sand, indicated generally at 32, and the second well 28 is shown to contain water, indicated generally at 34. However, it will be appreciated that alternatively, the first well 26 can contain water and the second well can contain sand, and furthermore, that each of the first well 26 and the second well 28 can contain sand or each of the first well 26 and second well 28 can contain water. Furthermore, either or both of the first well 26 and the second well 28 can contain children's toys and/or other play items and/or other material, for example earth or soil.

The partition 30 can have various configurations. For example, as shown in FIG. 2, a top portion of the partition 30 can be configured as a track, or road that can receive a toy vehicle, such as a toy car or truck. The base 12 can include other features associated with one or both of the first well 26 and the second well 28. For example, as shown in FIG. 2, the base 12 can include an island 36. The base 12 can define an aperture 50 (FIG. 3) that can be used to receive an accessory device. For example, aperture 50 can receive a pole of an umbrella (not shown) that can be used to shade children when table 10 is used outdoors.

Figure 3:
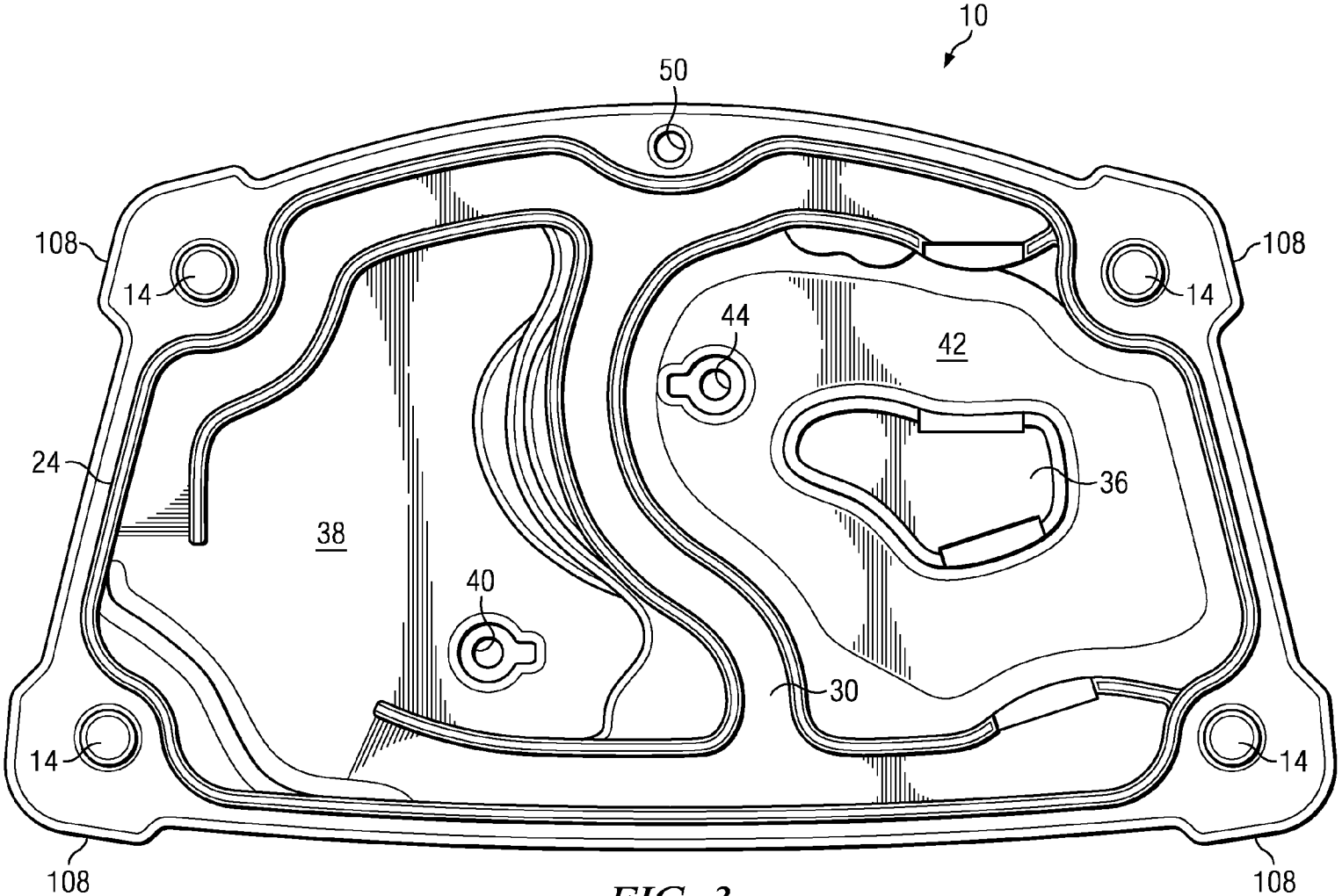
FIG. 3 is a top plan view of the table depicted in FIGS. 1 and 2, with the lid removed, and with the sand and water shown in FIG. 2 removed.

When the table 10 is not in use, any sand or water contained in one or both of the first well 26 and the second well 28, can be removed from table 10. The first well 26 and the second well 28 can each include one or more drain apertures to facilitate removal of sand and/or water or other material from table 10. For example, as shown in FIG. 3, the first well 26 can include a bottom 38 that can define a drain aperture 40, and the second well 28 can include a bottom 42 that can define a drain aperture 44. Table 10 can include drain plugs (not shown), to selectively plug the drain apertures 40 and 44, to facilitate filling wells 26 and 28, respectively, with water, sand, or other material that could otherwise escape through the drain apertures 40, 44.

The lid 18 can be selectively placed atop the base 12 when table 10 is not in use to protect the contents of the first well 26 and the second well 28, for example, children's toys and/or other play items, from undesired exposure to environmental conditions and/or animals. The lid 18 can include an upper surface 46 that can provide a play surface. The lid 18 can also include various decorative features and/or features used to identify table 10. For example, the lid 18 can include a medallion 48 that can include a company logo (not shown). In one embodiment, at least a portion of the upper surface 46 can be at least substantially smooth and/or can be generally planar, which can facilitate use of the upper surface 46 as a writing or play surface, for example.

The base 12 can be vertically adjustable relative to each of the legs 14 such that the position of base 12 above the support surface 16 is adjustable. For example, when the table 10 is in a first configuration shown in FIG. 1, the upper surface 20 of the base 12 can be positioned a first distance D1 above the support surface 16. When the table 10 is in a second configuration shown in FIG. 2, the upper surface 20 of base 12 is positioned a second distance D2 above the support surface 16. The distance D1 is shown to be greater than the distance D2, as will be appreciated with reference to FIGS. 1 and 2, such that use of the table 10 by relatively taller children can be facilitated by configuring the table 10 in the first configuration shown in FIG. 1. Use of the table 10 by relatively shorter children can be facilitated by configuring the table 10 in the second configuration shown in FIG. 2. While the lid 18 is shown to be positioned atop base 12 when the table 10 is in the first configuration shown in FIG. 1, and the lid 18 is shown to be removed from base 12 when the table 10 is in the second configuration shown in FIG. 2, it will be appreciated that lid 18 can be positioned atop base 12 or removed from base 12 when table 10 is in either the first or second configurations, which differ with respect to the vertical position of base 12 with respect to support surface 16.

Each of the legs 14 can support the base 12 and can be connected to base 12 in a variety of suitable configurations. In one embodiment, the table 10 can include a plurality of bands 60 and each of the legs 14 can be connected to the base 12 using one or more of the bands 60. Each of the bands 60 can be releasably attached to a respective one of the legs 14 as subsequently described, and with reference to FIGS. 4-6, 7A and 7B. Each of the legs 14 can include a plurality of band-engaging regions, that can be vertically spaced from one another, and each of the bands 60 can be selectively and releasably attached to a particular one of the band-engaging regions of a respective one of the legs 14, to achieve a desired position of the base 12 above the support surface 16.

Figure 4:
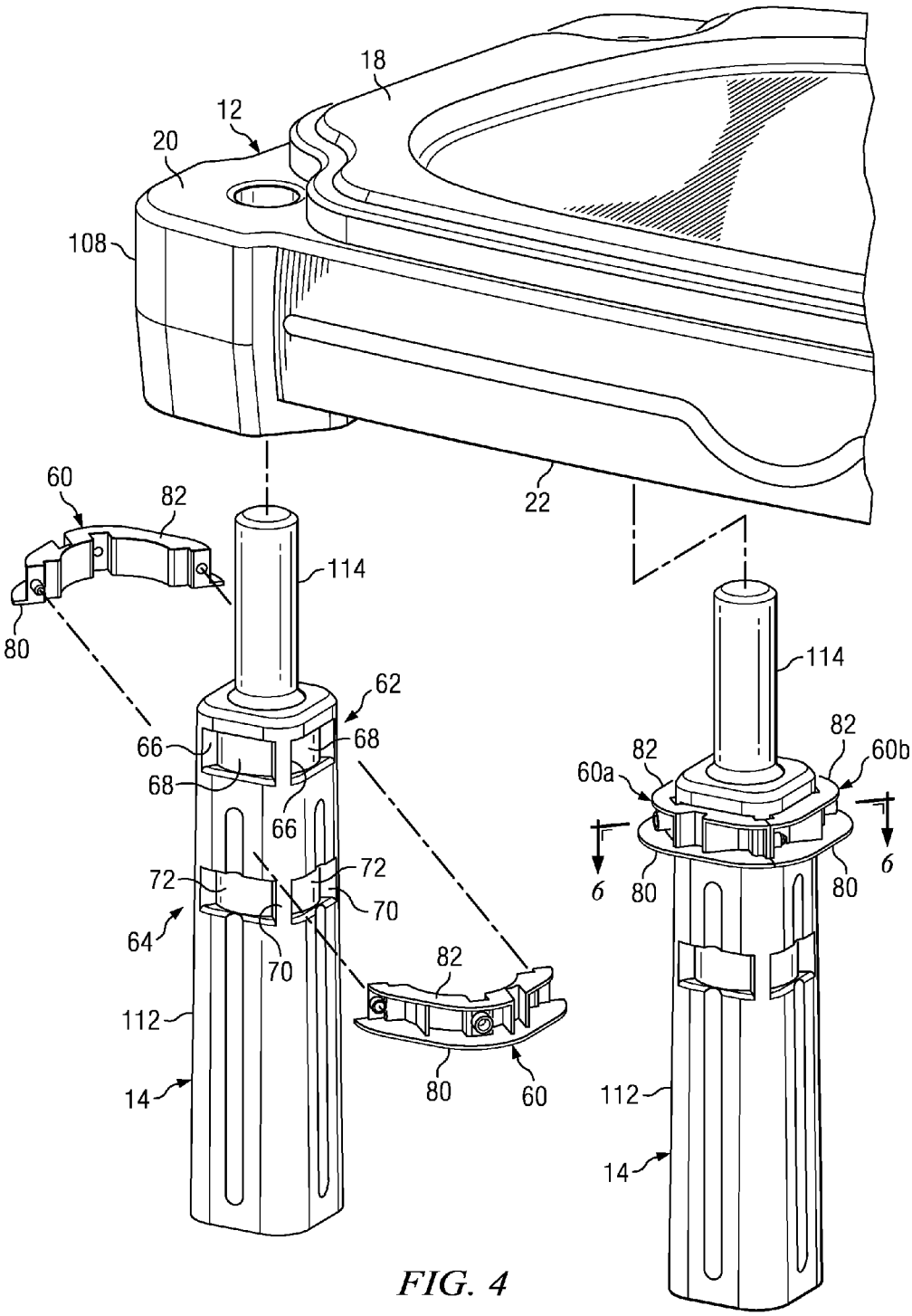
FIG. 4 is an enlarged, exploded perspective view depicting two legs, a portion of the base, and a portion of the lid, of the table shown in FIGS. 1-3.

In one embodiment, each of the legs 14 can include a first band-engaging region 62 and a second band-engaging region 64 that can be spaced from the first band-engaging region 62. The second band-engaging region 64 can be positioned below the first band-engaging region 62 as shown in FIG. 4. When each of the legs 14 is connected to the base 12 by at least one of the bands 60 that is releasably attached to the first band-engaging region 62 of the respective one of the legs 14, the table 10 can be selectively configured in the first configuration shown in FIG. 1. When each of the legs 14 is connected to the base 12 by at least one of the bands 60 that is releasably attached to the second band-engaging region 64 of the respective one of the legs 14, the table 10 can be selectively configured in the second configuration shown in FIG. 2. The first band-engaging region 62 can include a plurality of first ribs 66 that can be peripherally spaced from one another, and a plurality of first recesses 68, as shown in FIG. 4. Each of the first ribs 66 can be positioned between an adjacent pair of the first recesses 68, such that the first recesses 68 are peripherally spaced from one another. The second band-engaging region 64 can include a plurality of second ribs 70, which can be peripherally spaced from one another, and a plurality of second recesses 72. Each of the second ribs 70 can be positioned between an adjacent pair of the second recesses 72, such that the second recesses 72 are peripherally spaced from one another.

Figure 5:
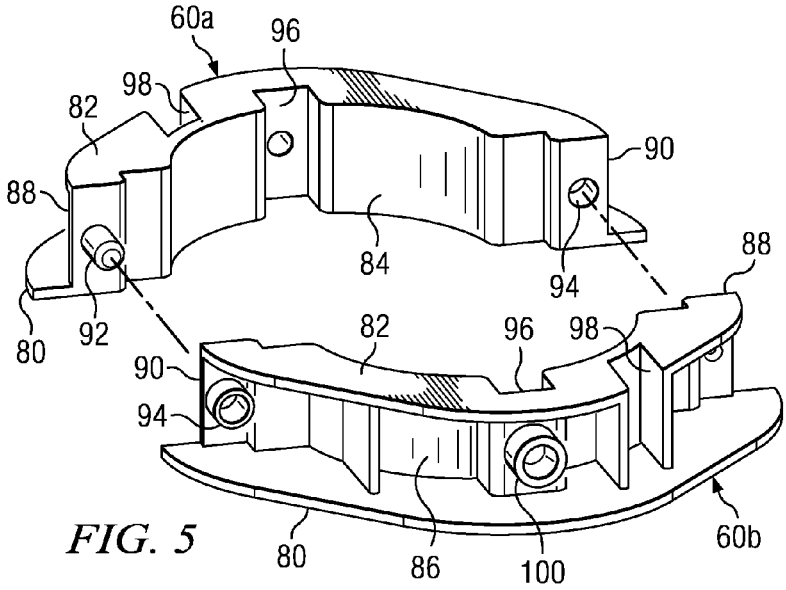
FIG. 5 is an enlarged perspective view of two bands depicted in FIG. 4, with the bands being depicted apart from the respective leg to which they can be releasably attached.
Figure 6:
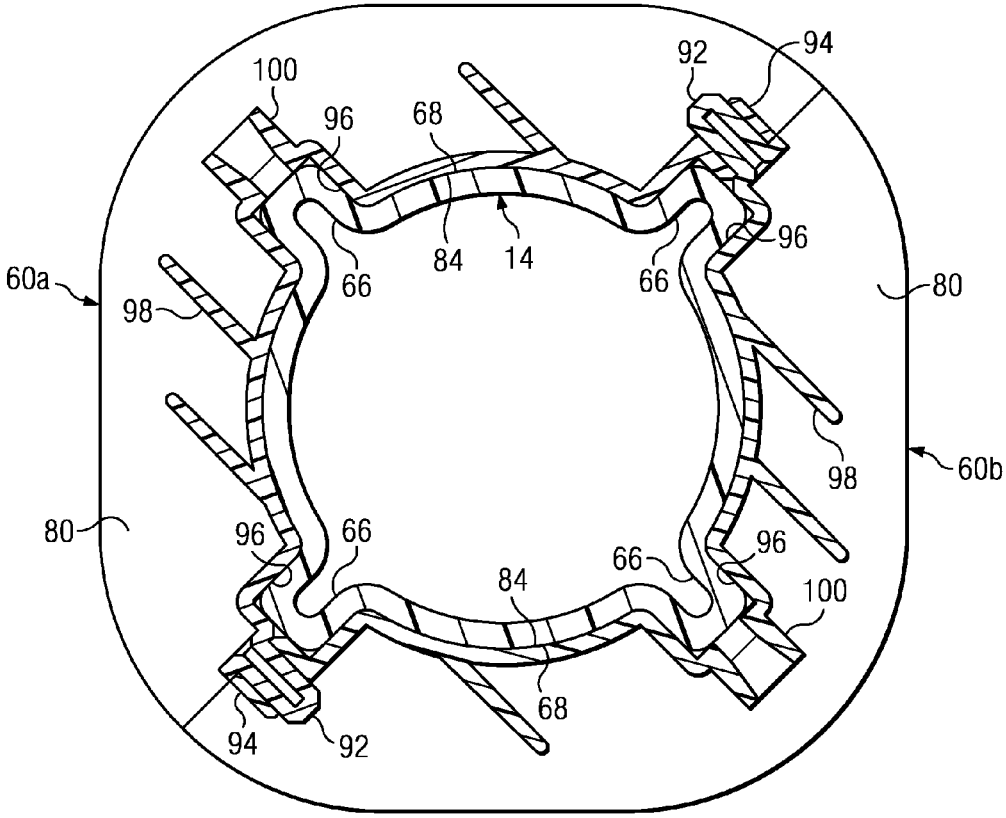
FIG. 6 is a cross-sectional view taken along line 6-6 in FIG. 4.

In the embodiment of FIGS. 1-9, for each of the legs 14, a pair of the bands 60 can be releasably attached to one another and to the first band-engaging region 62 of a respective one of the legs 14, as shown in FIGS. 4 and 6 with respect to one of the legs 14, to selectively configure the table 10 in the first configuration shown in FIG. 1, and can alternatively be releasably attached to one another and releasably attached to the second band-engaging region 64 of a respective one of the legs 14, to selectively configure the table 10 in the second configuration shown in FIG. 2. In other embodiments, a single band can be releasably attached to either a first band-engaging region or a second, vertically spaced band-engaging region, to achieve a desired configuration of a table, or alternatively, more than two bands can be attached to either one of the two vertically spaced band-engaging regions. Furthermore, it will be appreciated that more than two vertically spaced band-engaging regions can be provided on a leg, such that more than two vertical heights of a table can be achieved.

As shown in FIG. 5 with respect to the bands identified as 60*a* and 60*b*, each of the bands 60 can include a first flange 80, which can be a lower flange, and a second flange 82, which can be an upper flange, when the band 60 is attached to a respective leg 14. Each of the bands 60 can include an inner surface 84 and an outer surface 86. Each of the bands 60 can also include a first end 88 and a second end 90. Each band 60 of a pair of bands 60 can be releasably attached to a respective one of the legs 14, and can also be releasably attached to one another. Both bands 60 of a pair of bands 60 can be identical as shown in FIG. 5 with respect to bands 60*a* and 60*b*. In the embodiment of FIGS. 1-9, the end 88 of each one of the bands 60, of a pair of the bands 60, can be releasably attached to the end 90 of the other one of the pair of the bands 60. For example, the end 88 of each band 60 can include a pin 92 and the end 90 of each band 60 can include a sleeve 94. With reference to FIGS. 5 and 6, pin 92 of the band identified as 60*a* can be inserted into the sleeve 94 of the band identified as 60*b*. Similarly, the pin 92 (not shown) of the band identified as 60*b* can be inserted into the sleeve 94 of the band identified as 60*a*. It will be appreciated that a pin can be removably secured with a sleeve, e.g., sleeve 94, in an interference fit, or snap-fit, for example. FIG. 6 depicts the releasable attachment of the pair of bands 60*a* and 60*b* to the ribs 66 of the first band-engaging region 62 of one of the legs 14, and with the bands 60*a* and 60*b* releasably attached to one another.

As shown in FIG. 5, each of the bands 60 can define at least one inwardly-facing notch 96 and can also define at least one outwardly-facing notch 98. In the embodiment of FIGS. 1-9, each of the bands 60 is shown to include one inwardly-facing notch 96 and one outwardly-facing notch 98. In other embodiments, bands can include two or more inwardly-facing notches and/or two or more outwardly-facing notches and/or no outwardly-facing notches. Additionally, the first and second ones of a pair of bands 60 can cooperate to define two additional inwardly-facing notches 96. For example, as shown in FIG. 6, the end 88 of band 60*a* can cooperate with the end 90 of the band 60*b* to define another inwardly-facing notch 96 and similarly, the end 88 of the band 60*b* can cooperate with the end 90 of the band 60*a* to define another inwardly-facing notch 96, when the bands 60*a* and 60*b* are releasably attached to one another, such that each pair of bands 60 can define four of the inwardly-facing notches 96.

As shown in FIG. 6, each of the first ribs 66 of the first band-engaging region 62 can be received within a respective one of the inwardly-facing notches 96 defined by the pair of bands 60*a*, 60*b*, such that the bands 60*a* and 60*b* are in contacting engagement with the first band-engaging region 62 of the leg 14. Each of the bands 60*a* and 60*b* can partially surround the first band-engaging region 62. As also shown in FIG. 6, the pin 92 of band 60*a* can be inserted into the sleeve 94 of band 60*b*, and the pin 92 of band 62*b* can be inserted into the sleeve 94 of band 60*a*. As further shown in FIG. 6, portions of the inner surface 84 of each of the bands 60*a*, 60*b* can be in contacting engagement with respective ones of the first recesses 68 of the band-engaging region 62 of the leg 14. Each of the bands 60 can also include a collar 100 that can be configured to receive a male fastener (e.g., screw 130 shown in FIGS. 7A and 7B) as subsequently described in further detail.

The base 12 can also include a plurality of pockets 108. In the embodiment of FIGS. 1-9, the table 10 is shown to include four of the pockets 108, which are shown to be corner pockets. As subsequently described in further detail, each of the pockets 108 can be configured to receive a respective one of the legs 14. In other embodiments, a table can be provided that includes less than, or more than, four pockets that each can receive a respective leg of the table. Furthermore, one or more pockets can be provided that are not corner pockets of a table.

Figure 7A:
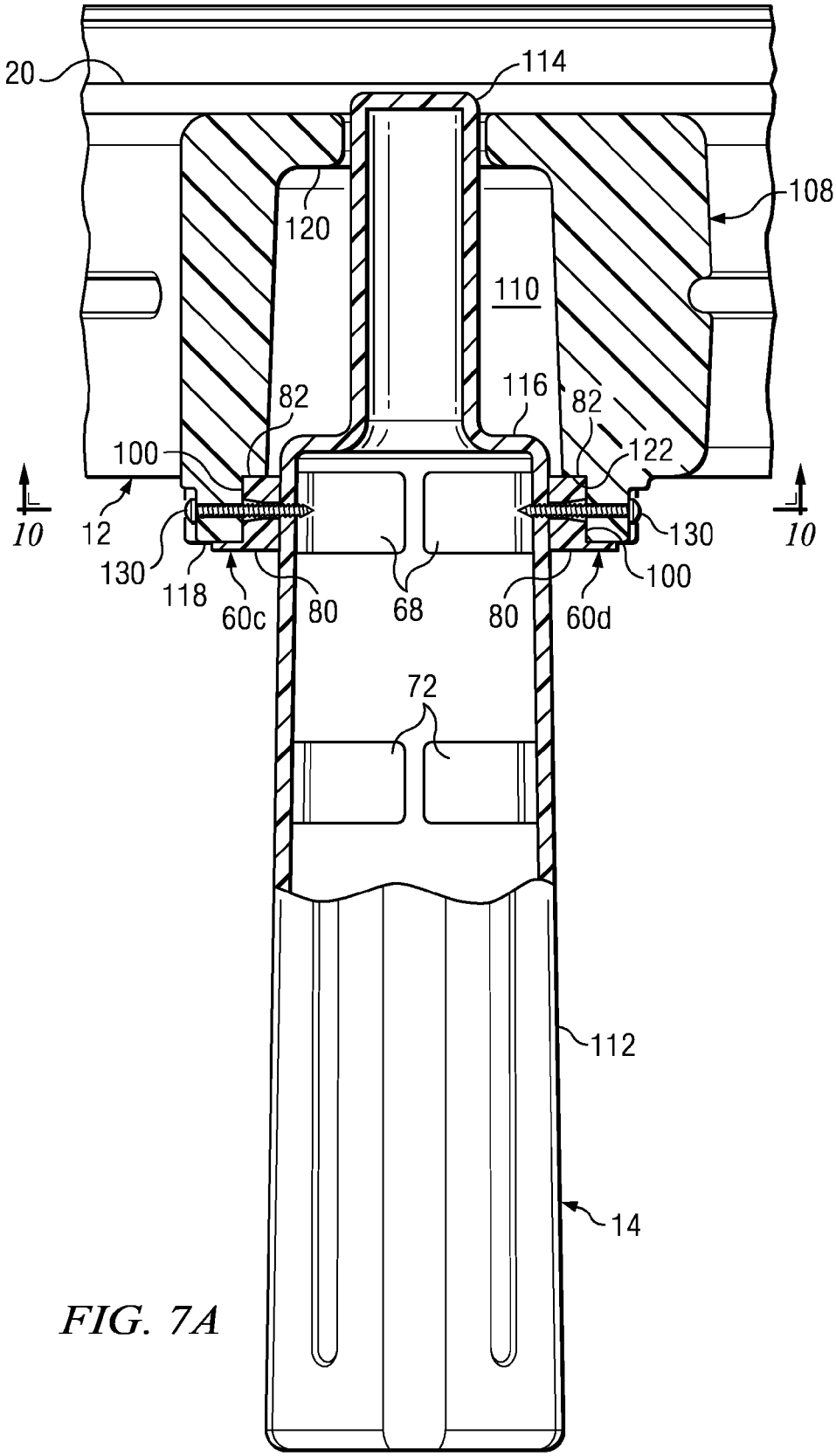
FIG. 7A depicts a portion of the table depicted in FIGS. 1-3, with the portion of the table being shown partially in a side elevational view and partially in a cross-sectional view taken along line 7-7 in FIG. 1, with one of the legs of the table inserted into a respective pocket of the base, and with the leg and the base depicted in a first vertical position relative to one another corresponding to the first configuration of the table shown in FIG. 1.
Figure 7B:
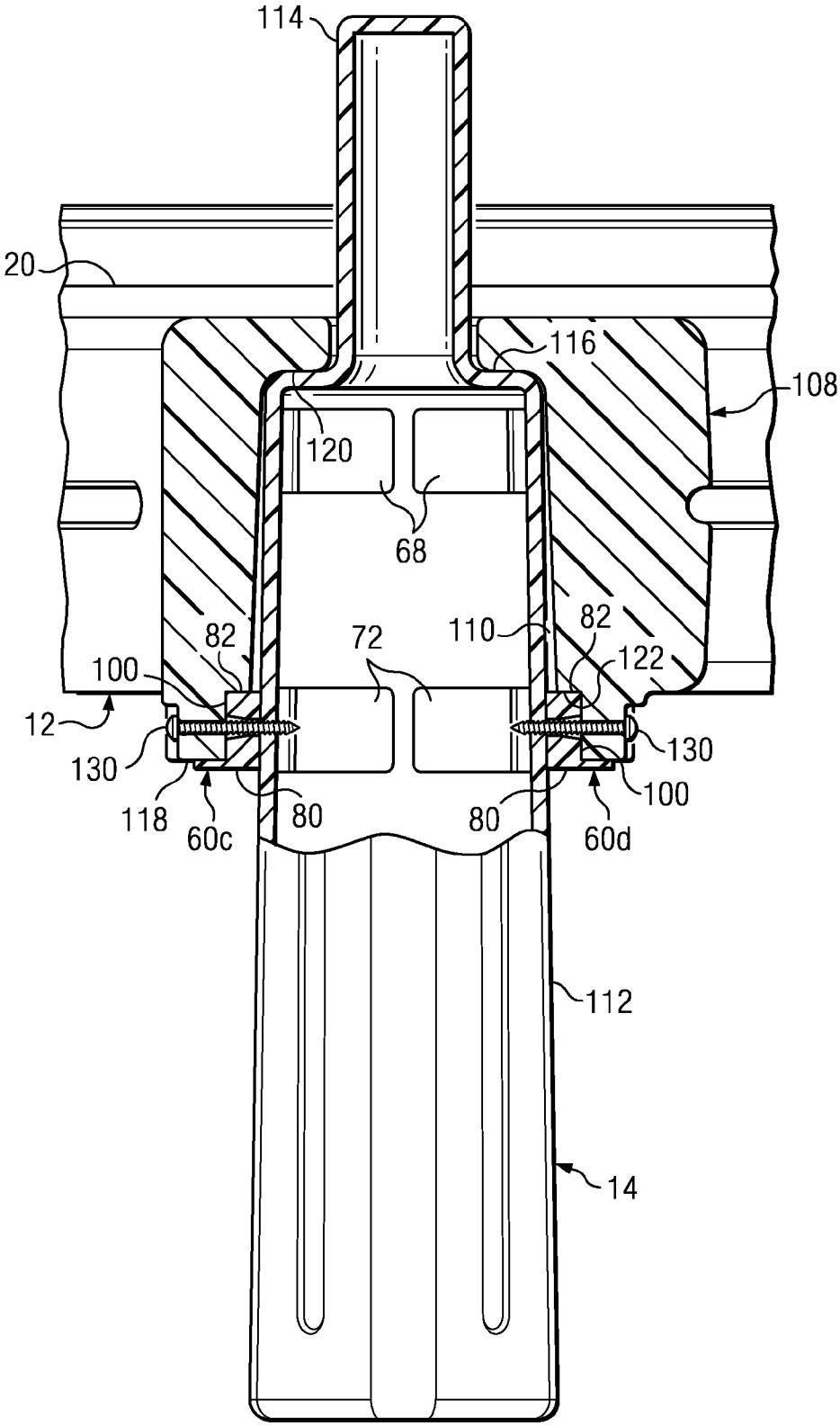
FIG. 7B is a cross-sectional view similar to FIG. 7A, but with the leg and the base depicted in a second vertical position relative to one another corresponding to the second configuration of the table shown in FIG. 2.
Figure 8:
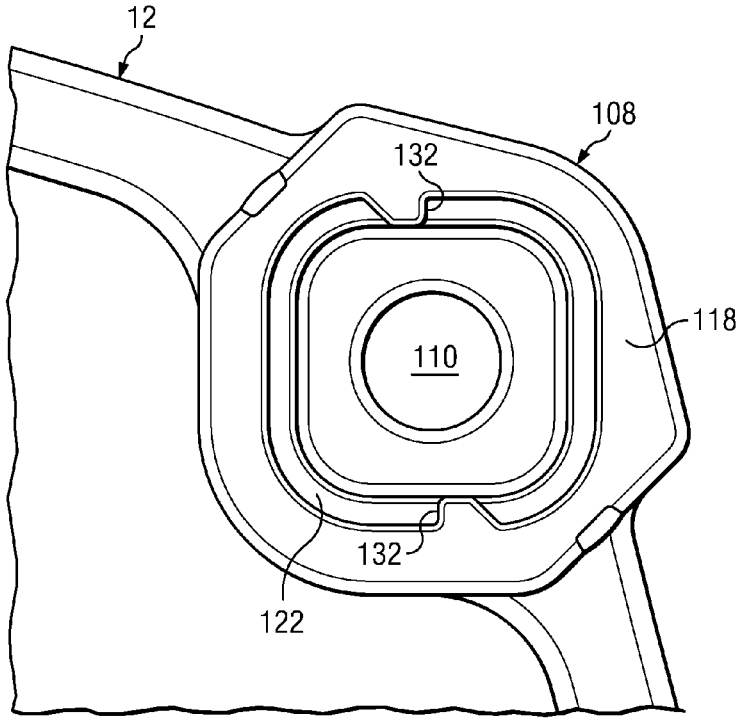
FIG. 8 is a bottom plan view of one of the pockets of the base of the table shown in FIGS. 1-3, with the respective leg removed from the pocket for clarity of illustration.

As shown in FIGS. 7A and 7B with respect to one of the pockets 108 and one of the legs 14, each of the legs 14 can be received by a respective aperture 110 defined by a respective one of the pockets 108.

Each of the legs 14 can include a lower portion 112 and an upper portion 114 that can be integral with the lower portion 112. The upper portion 114 can extend away from and above the lower portion 112. The lower portion 112 can include an upper, upwardly-facing surface 116 (FIGS. 7A and 7B) that can at least partially surround the upper portion 114. The upper portion 114 of leg 14 can be generally cylindrical. Each of the legs 14 can include a plurality of peripherally spaced, decorative indentations that can extend away from a respective one of the second band-engaging regions 64 as shown in FIG. 4, with portions of two of these indentations shown in the side elevational portion of each of FIGS. 7A and 7B, but with the remaining indentations omitted from the cross-sectional portion of each of FIGS. 7A and 7B for clarity of illustration.

As shown in FIGS. 7A and 7B, each of the pockets 108 can include a bottom surface 118 and an upper, downwardly-facing surface 120 that can partially define the respective aperture 110. Each of the pockets 108 can also include an—intermediate, downwardly-facing surface 122 that can be positioned between the bottom surface 118 and the upper, downwardly-facing surface 120 of the respective pocket 108. After the bands 60 have been releasably attached to respective ones of the legs 14, the legs 14 can be inserted into respective ones of the pockets 108, such that the legs 14 support the base 12 and the base 12 is positioned vertically relative to legs 14 and a support surface, e.g., support surface 16. In the embodiment of FIGS. 1-9, table 10 can be configured in a desired one of the first or second configurations shown in FIGS. 1 and 2, respectively, to achieve a desired height of table 10. For example, if a pair of the bands 60 is attached to the first band-engaging region 62 of each of the legs 14, each of the legs 14 can then be inserted into the aperture 110 defined by a respective one of the pockets 108, as depicted in FIG. 7A with respect to one of the legs 14, one of the pockets 108 and bands 60*c* and 60*d*, to configure the table 10 in the first configuration shown in FIG. 1. In this configuration, the upper portion 114 of each leg 14 can be substantially flush with the upper surface 20 of base 12, and the upper, upwardly-facing surface 116 of the lower portion 112 of each leg 14 can be spaced apart from and below the upper, downwardly-facing surface 120 of the respective one of the pockets 108. As also shown in FIG. 7A, in this configuration, the first flange 80 of each of the bands 60*c*, 60*d* can be in contacting engagement with the bottom surface 118 of the respective one of the pockets 108. The second flange 82 of each of the bands 60*c*, 60*d* can be in contacting engagement with the intermediate, downwardly-facing surface 122 of the respective one of the pockets 108.

Figure 9:
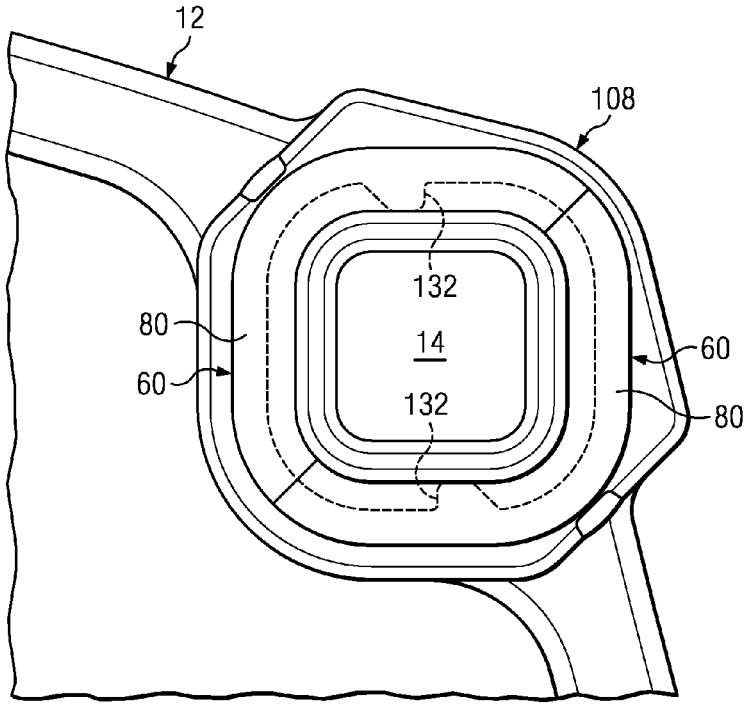
FIG. 9 is a bottom plan view similar to FIG. 8, but with the respective leg inserted into the pocket.
Figure 10:
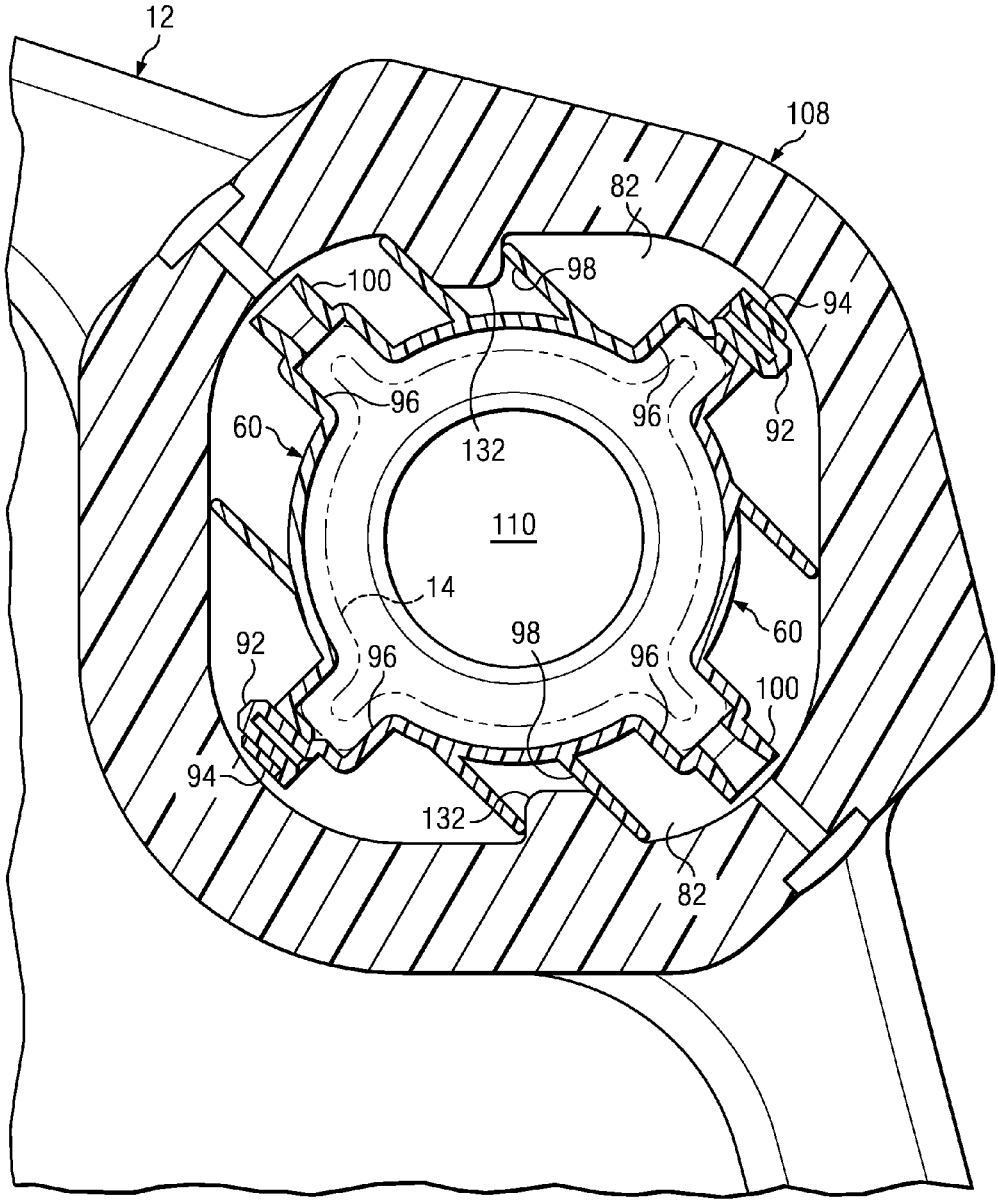
FIG. 10 is a cross-sectional view taken along line 10-10 in FIG. 7A, with one of the legs depicted in dashed lines, and with two screws depicted in FIG. 7A omitted for clarity of illustration.

Each of the pockets 108 can include one or more tabs that can be used to align the legs 14 within the respective pockets 108. For example, in the embodiment of FIGS. 1-9, each of the pockets 108 is shown to include a pair of tabs 132 (FIGS. 9 and 10). Each of the tabs 132 can extend inwardly and can be received by the outwardly-facing notch 98 of a respective one of the bands 60 such that each tab 132 engages a respective one of the bands 60, as shown in FIG. 10 with respect to one of the pockets 108 and the two included tabs 132. The tabs 132 can also cooperate with the outwardly-facing notches 98 to prevent each leg from rotating relative to the respective pocket 108. After the legs 14 have been inserted into the respective ones of the pockets 108, screws 130, or other appropriate fasteners, can be used to further releasably attach each of the legs 14 to the respective ones of the pockets 108.

For example, as shown in FIGS. 7A and 7B with respect to one of the pockets 108, one of the legs 14 and bands 60*c* and 60*d*, a first screw 130 can extend through the pocket 108, the collar 100 of the band 60*c*, and into leg 14, and a second screw 130 can extend through the pocket 108, the collar 100 of the band 60*d*, and into the leg 14. Screws 130 can be used to further releasably attach the remaining legs 14 to the respective ones of the pockets 108 of base 12 in a similar manner. The screws 130 can facilitate positioning the legs 14 relative to the respective ones of the pockets 108. In other embodiments, male fasteners, such as screws 130, can be omitted.

When it is desired to configure the table 10 in the second configuration shown in FIG. 2, to facilitate use by relatively shorter children, a pair of the bands 60 can be releasably attached to the second band-engaging region 64 of each of the legs 14 and to one another (much as described above with respect to the first band-engaging region 62), and each of the legs 14 can then be inserted into the aperture 110 defined by a respective one of the pockets 108, as depicted in FIG. 7B with respect to one of the legs 14, one of the pockets 108 and bands 60*c* and 60*d*. In this configuration, the upper portion 114 of each leg 14 can extend upwardly beyond the upper surface 20 of base 12 and the upper, upwardly-facing surface 116 of the lower portion 112 of each leg 14 can be positioned in contacting engagement with the upper, downwardly-facing surface 120 of the respective one of the pockets 108. Also, similar to the configuration shown in FIG. 7A, in the configuration shown in FIG. 7B, the first flange 80 of each of the bands 60*c*, 60*d* can be in contacting engagement with the bottom surface 118 of the respective one of the pockets 108. The second flange 82 of each of the bands 60*c*, 60*d* can be in contacting engagement with the intermediate, downwardly-facing surface 122 of the respective one of the pockets 108. After legs 14 are inserted in pockets 108, screws 130 can be installed as described previously.

When it is desired to change the configuration of table 10, screws 130 can be removed and legs 14 can be removed from pockets 108. The bands 60 can be removed from the one of the first band-engaging region 62 and the second band-engaging region to which they are releasably attached, and then releasably attached to the other one of the first band-engaging region 62 and the second band-engaging region 64. Legs 14 can then be re-inserted into pockets 108 and screws 130 can then be used as described above to further releasably attach the legs 14 to pockets 108.

Various components of table 10, e.g., base 12, legs 14, lid 18 and bands 60, can be molded from a suitable polymeric material, using a suitable molding process. In the embodiment of FIGS. 1-9, legs 14 and lid 18 can each be formed from a suitable thermoplastic material using either a rotomolding process, a blow molding process, or an injection molding process, and base 12 can be formed from a suitable thermoplastic material using a rotomolding process. In another embodiment, a base can be configured to facilitate molding from a suitable thermoplastic material using a blow molding process. Also, in the embodiment of FIGS. 1-9, the bands 60 can be formed from a suitable thermoplastic material using an injection molding process.

The multiple configurations of table 10 allow children of various ages and sizes to enjoy the use of table 10. For example, table 10 can be configured as shown in FIG. 1 to facilitate the use of table 10 by relatively taller children, and the table 10 can be configured as shown in FIG. 2 to facilitate use of table 10 by relatively smaller, or shorter children. Also, table 10 is configured such that it is multi-functional. For example, the incorporation of one or more wells allows children to at least partially fill each of the wells with sand, water or other material for the enjoyment of the child. In the embodiment of FIGS. 1-9, wells 26 and 28, and partition 30 which separates the wells 26 and 28, permits a child to play in sand, soil or other material located in one of the wells 26 and 28 and to also enjoy playing in water, for example, in the other one of the wells 26 and 28. Furthermore, the partition 30 may have a variety of configurations, such as a road or track, to accommodate a toy vehicle such as a car or truck to further the enjoyment of the child using table 10. One or both of the wells 26 and 28 can also contain one or more toys or other play items. When table 10 is not in use, any water in wells 26 or 28 can be drained using drain apertures 40 and 44, respectively. Drain apertures 40, 44 can also facilitate removing other material, e.g., sand from one or both of the wells 26, 28. The lid 18 can selectively cover the wells 26 and 28, when the table 10 is not in use to protect any toys or other play items contained within one or both of the wells 26, 28 from the environment and/or from animals, for example. The releasable attachment of the legs 14 to the base 12 can minimize the storage space required to store and/or ship the table 10. In one embodiment, legs and bands, when disassembled, can be stored within wells.

While various embodiments of an adjustable height table have been depicted by the foregoing description and have been described in considerable detail, it is not intended to restrict or in any way limit the scope of the appended claims to such detail. Additional modifications will be readily apparent to those, skilled in the art.

The invention claimed is:

1. A table comprising:

a base, the base comprising an upper surface and a plurality of pockets;

a plurality of legs supporting the base, each of the legs comprising a first band-engaging region and a second band-engaging region spaced from the first band-engaging region; and a plurality of bands; wherein each of the pockets of the base comprises a bottom surface and defines an aperture extending through the bottom surface;

each of the legs is received by the aperture defined by a respective one of the pockets of the base;

the table is selectively configurable in a first configuration wherein the upper surface of the base is positioned a first distance above a support surface, upon which the legs are configured to rest, the table being further selectively configurable in a second configuration wherein the upper surface of the base is positioned a second distance above a support surface, upon which the legs are configured to rest, the first distance being greater than the second distance;

each of the bands is releasably attached to, and at least partially surrounds, the first band-engaging region of a respective one of the legs, and is in contacting engagement with the base, when the table is in the first configuration;

each of the bands is releasably attached to, and at least partially surrounds, the second band-engaging region of the respective one of the legs, and is in contacting engagement with the base, when the table is in the second configuration;

each of the pockets further comprises an upper, downwardly-facing surface, the upper, downwardly-facing surface of each of the pockets partially defining a respective one of the apertures;

each of the bands comprises a first flange; and the first flange of each of the bands is in contacting engagement with the bottom surface of the respective one of the pockets of the base when the table is in the first configuration, and when the table is in the second configuration.

2. The table of claim 1, wherein:

the plurality of the bands comprises a plurality of pairs of the bands;

for each of the pairs of the bands, a first one of the pair of the bands is releasably attached to a second one of the pair of the bands;

each of the pairs of the bands is releasably attached to the first band-engaging region of the respective one of the legs when the table is in the first configuration; and each of the pairs of the bands is releasably attached to the second band-engaging region of the respective one of the legs when the table is in the second configuration.

3. The table of claim 2, wherein:

for each of the legs, the first band-engaging region comprises a plurality of first ribs, the first ribs being peripherally spaced from one another;

for each of the legs, the second band-engaging region comprises a plurality of second ribs, the second ribs being peripherally spaced from one another;

each of the bands, of each of the pairs of the bands, defines at least one inwardly-facing notch;

the at least one inwardly-facing notch of each of the bands, of each of the pairs of the bands, receives a respective one of the first ribs, of the respective one of the legs, when the table is in the first configuration; and the at least one inwardly-facing notch of each of the bands, of each of the pairs of the bands, receives a respective one of the second ribs, of the respective one of the legs, when the table is in the second configuration.

4. The table of claim 3, wherein:

for each of the pairs of the bands, a first one of the bands defines a first inwardly-facing notch, a second one of the bands defines a second inwardly-facing notch, and the first and second ones of the bands cooperate to define a third inwardly-facing notch and a fourth inwardly-facing notch.

5. The table of claim 1, wherein:

each of the pockets further comprises an intermediate, downwardly-facing surface, the intermediate, downwardly-facing surface being positioned between the upper, downwardly-facing surface and the bottom surface;

each of the bands further comprises a second flange; and the second flange of each of the bands is in contacting engagement with the intermediate, downwardly-facing surface of the respective one of the pockets of the base when the table is in the first configuration, and when the table is in the second configuration.

6. The table of claim 5, wherein:

each of the legs comprises a lower portion and an upper portion, the upper portion being integral with the lower portion, the upper portion extending away from and above the lower portion, the lower portion comprising an upper, upwardly-facing surface at least partially surrounding the upper portion;

the upper, upwardly-facing surface of the lower portion of each of the legs is spaced apart from and below the upper, downwardly-facing surface of the respective one of the pockets when the table is in the first configuration; and the upper, upwardly-facing surface of the lower portion of each of the legs contacts the upper, downwardly-facing surface of the respective one of the pockets of the base when the table is in the second configuration.

7. The table of 1, wherein:

the base further comprises at least one well, the at least one well having an open top and configured to contain at least one of sand and water.

8. The table of claim 7, wherein:

the at least one well comprises a first well and a second well; and the base further comprises a partition separating the first well and the second well.

9. The table of claim 8, wherein:

the first well comprises a first bottom and the second well comprises a second bottom; and each of the first bottom and the second bottom is positioned below the upper surface of the base and defines at least one drain aperture.

10. The table of claim 8, further comprising:

a lid, the lid being selectively positioned atop the base such that the lid selectively covers the first well and the second well.

11. The table of claim 7, wherein:

the at least one well comprises a bottom, the bottom being positioned below the upper surface of the base and defining at least one drain aperture.

12. The table of claim 7, further comprising:

a lid, the lid being selectively positioned atop the base such that the lid selectively covers the at least one well.

13. The table of claim 12, wherein:

the base comprises a perimeter lip extending above the upper surface of the base, the lid surrounding the perimeter lip.

* * * * *